US011062590B2

(12) United States Patent
Lee et al.

(10) Patent No.: US 11,062,590 B2
(45) Date of Patent: Jul. 13, 2021

(54) SYSTEMS AND METHODS OF PROVIDING ALLOWANCES FOR A SECURITY SYSTEM

(71) Applicant: Google Inc., Mountain View, CA (US)

(72) Inventors: Jeffery Theodore Lee, Los Gatos, CA (US); Sophie Le Guen, Burlingame, CA (US); Jeffrey Alan Boyd, Novato, CA (US)

(73) Assignee: Google LLC, Mountain view, CA (US)

( * ) Notice: Subject to any disclaimer, the term of this patent is extended or adjusted under 35 U.S.C. 154(b) by 746 days.

(21) Appl. No.: 14/585,272

(22) Filed: Dec. 30, 2014

(65) Prior Publication Data

US 2016/0189528 A1 Jun. 30, 2016

(51) Int. Cl.
*G08B 25/00* (2006.01)

(52) U.S. Cl.
CPC ..... *G08B 25/008* (2013.01)

(58) Field of Classification Search
CPC ..... G08B 25/008
See application file for complete search history.

(56) References Cited

U.S. PATENT DOCUMENTS

| | | | | |
|---|---|---|---|---|
| 4,683,460 | A | 7/1987 | Nakatsugawa | |
| 4,754,255 | A | 6/1988 | Sanders et al. | |
| 4,951,029 | A | 8/1990 | Severson | |
| RE35,268 | E | 6/1996 | Frolov et al. | |
| 6,909,921 | B1 | 6/2005 | Bilger | |
| 8,269,602 | B2 | 9/2012 | Graichen | |
| 8,531,294 | B2 * | 9/2013 | Slavin | G08B 13/2402 340/539.13 |
| 2006/0181401 | A1 * | 8/2006 | Martin | G08B 15/002 340/506 |
| 2006/0181408 | A1 * | 8/2006 | Martin | G08B 25/008 340/528 |
| 2007/0198850 | A1 | 8/2007 | Martin et al. | |
| 2007/0247302 | A1 * | 10/2007 | Martin | G08B 25/008 340/506 |
| 2010/0045461 | A1 * | 2/2010 | Caler | G08B 25/008 340/541 |
| 2010/0097225 | A1 | 4/2010 | Petricoin et al. | |
| 2010/0245088 | A1 * | 9/2010 | Meier | G08B 13/18 340/545.1 |

(Continued)

OTHER PUBLICATIONS

"Invitation to Pay Additional Fees and, Where Applicable, Protest Fee", Mar. 21, 2016, p. 6.

(Continued)

*Primary Examiner* — Patrick N Edouard
*Assistant Examiner* — Eboni N Giles
(74) *Attorney, Agent, or Firm* — Butzel Long

(57) ABSTRACT

Systems and methods of security are provided, including a sensor to detect a location of at least one user, and generate detection data according to the detected location of the at least one user, a processor communicatively coupled to the sensor to receive the detection data, to determine whether the at least one user is occupying a building according to the detection data, and to store allowance data that sets one or more preferences for the at least one user, and an alarm device, communicatively coupled to at least the processor, that is armed or disarmed by the processor according to the allowance data and the determination as to whether the at least one user is occupying the building.

30 Claims, 6 Drawing Sheets

(56) References Cited

U.S. PATENT DOCUMENTS

| | | | | |
|---|---|---|---|---|
| 2010/0277302 | A1 | 11/2010 | Cohn et al. | |
| 2010/0280635 | A1 | 11/2010 | Cohn et al. | |
| 2010/0289644 | A1 | 11/2010 | Slavin et al. | |
| 2011/0102588 | A1* | 5/2011 | Trundle | H04N 7/188 348/143 |
| 2012/0019353 | A1* | 1/2012 | Knasel | G08B 25/008 340/4.35 |
| 2012/0154138 | A1* | 6/2012 | Cohn | G08B 25/004 340/501 |
| 2013/0215266 | A1* | 8/2013 | Trundle | G08B 13/19602 348/143 |
| 2014/0266699 | A1* | 9/2014 | Poder | G08B 25/008 340/539.13 |

OTHER PUBLICATIONS

PCT/US2015/064675, International Search Report and Written Opinion issued in PCT/US2015/064675 dated May 31, 2016, May 31, 2016, p. 16.

IPRP dated Jul. 13, 2017 as received in Application No. PCT/US2015/064675.

* cited by examiner

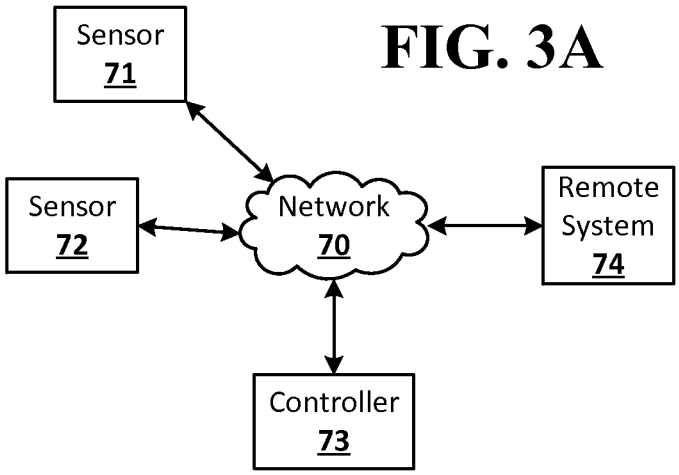
FIG. 3A
FIG. 3B
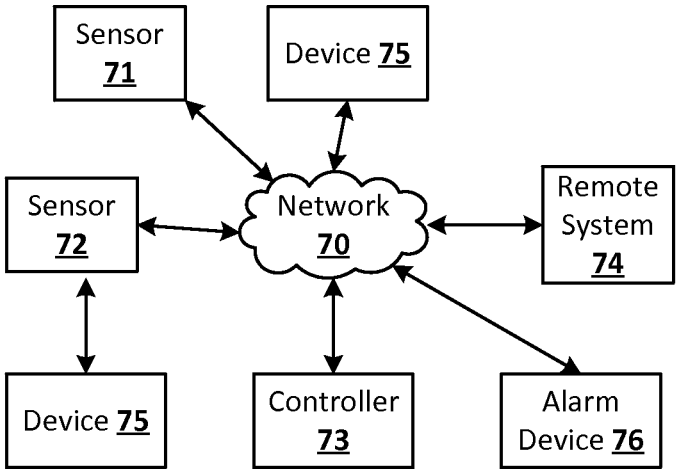

SYSTEMS AND METHODS OF PROVIDING ALLOWANCES FOR A SECURITY SYSTEM

BACKGROUND

Traditional home security systems must be armed by a user prior to leaving a home. Typically, a user has a preset time, such as 30 seconds, to exit the home prior to the arming of the home security system. As the time requirement associated with arming the home security system is difficult for the user to adhere to, or the security system is difficult to use, the user may choose not to arm the home security system when the user leaves. That is, the user must frequently rush out of the home before the preset time runs out, or risk inadvertently triggering the alarm.

BRIEF SUMMARY

Embodiments of the disclosed subject matter herein are directed towards systems and methods of providing allowances (e.g., entry and exit allowances) for a security system for a home or building. The security system uses sensor signal data and user history data (e.g., regarding which doors the user has exit from, the duration that a particular user takes to exit the home, the times in which the user leaves the home, and the like) to allow the user to exit after an alarm device of the security system is armed. The user history data may be used by the security system to determine that a user is not exiting the home as normal, and may adjust the amount of time with an alarm device for the user to leave. The security systems and methods disclosed herein may adjust the amount of time for users to exit the home, so that an alarm will not be output and/or notification messages transmitted from an alarm device while users are attempting to exit the home. The exit allowances that may be provided for the security system may include: refraining from enabling the sensors from triggering an alarm event until the registered users have left the home; refraining from triggering an alarm event (e.g., outputting an audio and/or visual alarm, and/or transmitting a notification message to a device) when doors to the home are opened from the inside so that a user may exit; selecting one or more doors of the home to be exit doors after arming the alarm device of the security system; refraining from triggering an alarm event when interior doors are opened and/or closed; providing a failsafe period for users to exit the home after the alarm device of the security system is armed; reducing the failsafe period when the sensors detect that the users have exited the home; providing for perimeter-only triggering of an alarm event; and providing a stay mode, which allows for users to move about the home and/or the area surrounding the home without triggering an alarm event while the alarm device is armed.

According to an embodiment of the disclosed subject matter, a system is provided that includes a sensor to detect a location of at least one user, and generate detection data according to the detected location of the at least one user, a processor communicatively coupled to the sensor to receive the detection data, to determine whether the at least one user is occupying a building according to the detection data, and to store allowance data that sets one or more preferences for the at least one user, and an alarm device, communicatively coupled to at least the processor, that is armed or disarmed by the processor according to the allowance data and the determination as to whether the at least one user is occupying the building.

According to an embodiment of the disclosed subject matter, a method is provided that includes detecting, by a sensor, a location of at least one user, and generating detection data according to the detected location of the at least one user, receiving, by a processor communicatively coupled to the sensor, the detection data, determining whether the at least one user is occupying a building according to the detection data, and storing allowance data that sets one or more preferences for the at least one user, and arming an alarm device that is communicatively coupled to the processor according to the allowance data and the determination as to whether the at least one user is occupying the building.

According to an embodiment of the disclosed subject matter, means for providing exit allowances for a security system are provided includes detecting, by a sensor, a location of at least one user, and generating detection data according to the detected location of the at least one user, receiving, by a processor communicatively coupled to the sensor, the detection data, determining whether the at least one user is occupying a building according to the detection data, and storing allowance data that sets one or more preferences for the at least one user, and arming an alarm device that is communicatively coupled to the processor according to the allowance data and the determination as to whether the at least one user is occupying the building.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

FIGS. 3A-3B show a security system according to embodiments of the disclosed subject matter.

DETAILED DESCRIPTION

Figure 1:
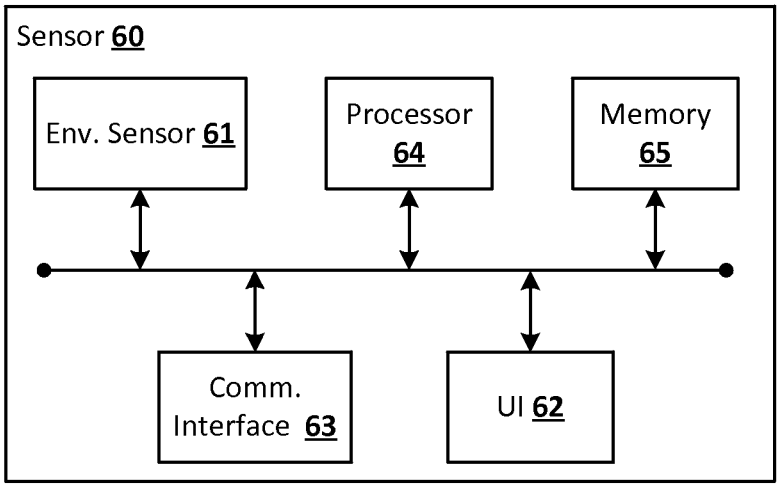
FIG. 1 shows an example sensor according to an embodiment of the disclosed subject matter.

Embodiments of the disclosed subject matter provide entry and/or exit allowances for a security system for a home or building. The security system may use sensor signal data and user history data (e.g., regarding which doors the user has exit from, the duration that a particular user takes to exit the home, the times in which the user leaves the home, and the like) to allow the system to transition from a first operation mode while the user is attempting to exit the home or building (e.g., a transition mode) to a second operation mode when it is determined that the user has exited (e.g., an away mode).

The security system of the smart-home environment may have a plurality of operation modes. For example, the system may include an away mode, a stay mode, a home mode, a vacation mode, a transition mode, and the like. According to the detected movement of the user, the system may change the operation mode.

The system may operate in a stay mode when users are determined to be in a home or building, but the users are not actively moving about the home or building (e.g., such as at night, when the users may be sleeping). In the stay mode, the system may distinguish between a user opening a door or window for ventilation (e.g., where a door or window is opened from inside the home or building), and a security event (e.g., where a door or window may be opened from the outside).

The system may operate in a home mode when users are determined to be actively moving about the home or building. In the stay mode, the system may distinguish between a user opening a door or window from inside the home or building, and a security event, where a door or window is opened from the outside.

The system may operate in an away mode when the home or building is determined to be unoccupied, according to the detected data from the sensors.

The system may use detected data from the sensors to track user movement, and may determine, based on patterns of movement or past user behaviors, whether the user is intending to leave. When the system determines that a user is attempting to leave, the system may enter a transition mode to allow for the user to exit the home without the system outputting an alarm and/or transmitting a notification message. When the system has determined that the user has exited, the system may change the operation mode from the transition mode to another operation mode. That is, when the system determines that there are no occupants in the home or building, the system may change from the transition mode to the away mode. When the system determines that there are other users in the home that are not actively moving about the home, the system may change from the transition mode to the stay mode. When the system determines that there are other users actively moving about the home, the system may change from the transition mode to the home mode.

The system may change from an away mode to a vacation mode when the user is away from the home of building for a predetermined period of time (e.g., one day, two days, one week, or the like). The system, with permission from the user, may acquire information from a user device (e.g., smartphone, wearable computing device, laptop computer, and/or other computing device), such as calendar and/or email data that may indicate that the user is going on vacation and/or will be travelling outside of the home or building for a particular period of time. The system may, for example, use geofencing information at an airport or train station to determine that the user may be travelling, and thus the system may change the operating mode of the system to a vacation mode.

The security systems and methods disclosed herein may adjust the amount of time for users to enter or exit the home, so that the alarm device will not be activated (e.g., an alarm will not be output and/or a notification message will not be transmitted) while users are attempting to enter or exit the home. The entry and exit allowances for the security system may be set by a user and/or determined from user history data. The user history data may be used by the security system to determine that a user is not exiting the home as normal, and may adjust the amount of time with an alarm device for the user to leave. The allowances may include, for example: refraining from enabling the sensors from triggering an alarm event (e.g., an alarm will not be output and/or a notification message will not be transmitted) until the registered users have left the home; refraining from triggering an alarm event when doors to the home are opened from the inside so that a user may exit; selecting one or more doors of the home to be exit doors after arming the alarm device of the security system; refraining from triggering an alarm event when interior doors are opened and/or closed; providing a failsafe period for users to exit the home after the alarm device of the security system is armed; reducing the failsafe period when the sensors detect that the users have exited the home; providing for perimeter-only triggering of an alarm event; and providing a stay mode, which allows for users to move about the home and/or the area surrounding the home without triggering an alarm event while the alarm device is armed.

As the entry and exit allowances for the security system may be set by a user and/or "learned" from the user's history with the security system, the switching between modes of the security system may occur, so as to be personalized to the user and/or members of the user's household. The embodiments disclosed herein may provide that the security system that reduces the number of false and/or unwanted alarms, due to the personalization and system learning of the user's entry and exit. That is, the embodiments of the disclosed subject matter may provide systems and methods to provide allowances for entry and exiting of a home or building that are personalized and flexible, and that minimize unauthorized entry and false alarms.

The allowances for the security system may change an operation mode of the security system according to a room that the user is determined to be in. For example, the system may change to a stay mode or other heightened security mode when the user is in a bedroom, and may change the operation mode when the user moves to another room in the home, such as the kitchen or the garage.

The allowances for the security system may notify the user of the exit points which may cause an alarm to sound when the user is determined to be leaving through a particular door. For example, if the system determines that the user is attempting to exit through a front door or a garage door, the system may notify the user that a back door or side door is secure. If the system determines that the user is attempting to exit through the back door or side door that was previously notified as being secure, the system may remove the restriction, so that the user may exit through the door of their choice without an alarm being output.

The system may notify the user in a change of operating mode of the security system. For example, the operating mode and/or a change in operating mode may be displayed on a display device of the system, and/or may be displayed on a screen or other display of a user device (e.g., smartphone, wearable computing device, or the like). For convenience to the user, the operating mode of the security system may be represented by a color (e.g., red, yellow, green, blue, or the like) so that a user can easily determine which operating mode the security system is in. The system may flash the display color when the mode is changing to a different mode, or when the system is in a transition mode. Alternatively, or in addition, the security system may output an audio notification of the operating mode and/or change in operating mode. The security system may request approval from the user to change the operating mode, such as from a voice command, a key input on a controller, and/or an input from a user device (e.g., smartphone, wearable computing device, or the like).

That is, the security system may use the allowances to govern system operation so as to change modes according to the movement of the user within the home or building (e.g., according to movement to particular rooms), as well as movement indicative of an exit from the home or building, so as to meet the security preferences of the user, and to minimize unwanted alarms when the user is attempting to exit the home or building.

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, and the like. A sensor can include, for example, a camera, a retinal camera, and/or a microphone.

A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is operating in an away mode, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

A sensor may include hardware in addition to the specific physical sensor that obtains information about the environment. FIG. 1 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices.

A user interface (UI) 62 may provide information (e.g., via a display device or the like) and/or receive input from a user of the sensor. The UI 62 may include, for example, a speaker to output an audible alarm and/or message when an event is detected by the sensor 60. The speaker may output a message to an authorized user regarding the operational status (e.g., there are no security and/or environmental events, an operational issue has been detected, and/or a security event and/or environmental event has been detected) of the security system disclosed herein, when, for example, the user arrives at the building (e.g., the user's home, the user's office, or the like), or when the user exits the building. The speaker may output an audible message for a user to access information regarding the operational status of the security system, for example, when the user arrives at the building (e.g., a home, an office, or the like) via an application installed and/or accessible from an electronic device (e.g., device 75 illustrated in FIG. 3B and/or computing device 20 illustrated in FIG. 5). Alternatively, or in addition, the UI 62 may include a light to be activated when an event is detected by the sensor 60. The user interface may be relatively minimal, such as a limited-output display, or it may be a full-featured interface such as a touchscreen.

Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Figure 2A:
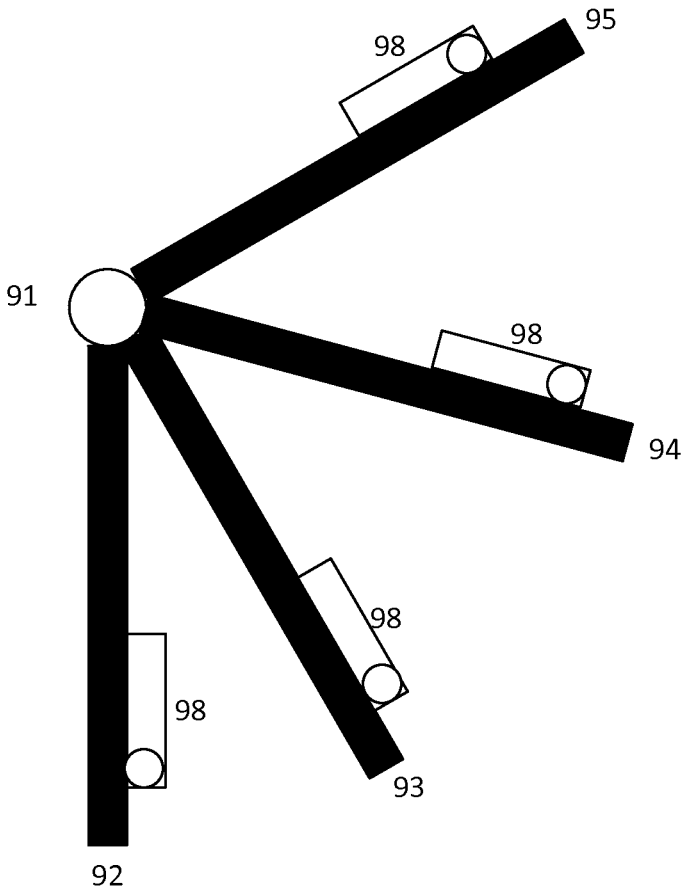
FIGS. 2A-2B show example sensors according to an embodiment of the disclosed subject matter.

As a specific example, a security system may employ a magnetometer affixed to a door jamb and a magnet affixed to the door. When the door is closed, the magnetometer may detect the magnetic field emanating from the magnet. If the door is opened, the increased distance may cause the magnetic field near the magnetometer to be too weak to be detected by the magnetometer. If the security system is activated, it may interpret such non-detection as the door being ajar or open. In some configurations, a separate sensor or a sensor integrated into one or more of the magnetometer and/or magnet may be incorporated to provide intelligence as to the status of the door. For example, an accelerometer and/or a compass may be affixed to the door and indicate the status of the door and/or augment the data provided by the magnetometer. FIG. 2A shows a schematic representation of an example of a door that opens by a hinge mechanism 81. In the first position 82, the door is closed and the compass 98 may indicate a first direction. The door may be opened at a variety of positions as shown 93, 94, 95. The fourth position 95 may represent the maximum amount the door can be opened. Based on the compass 98 readings, the position of the door may be determined and/or distinguished more specifically than merely open or closed. In the second position 93, for example, the door may not be far enough apart for a person to enter the home. A compass or similar sensor may be used in conjunction with a magnet, such as to more precisely determine a distance from the magnet, or it may be used alone and provide environmental information based on the ambient magnetic field, as with a conventional compass.

Figure 2B:
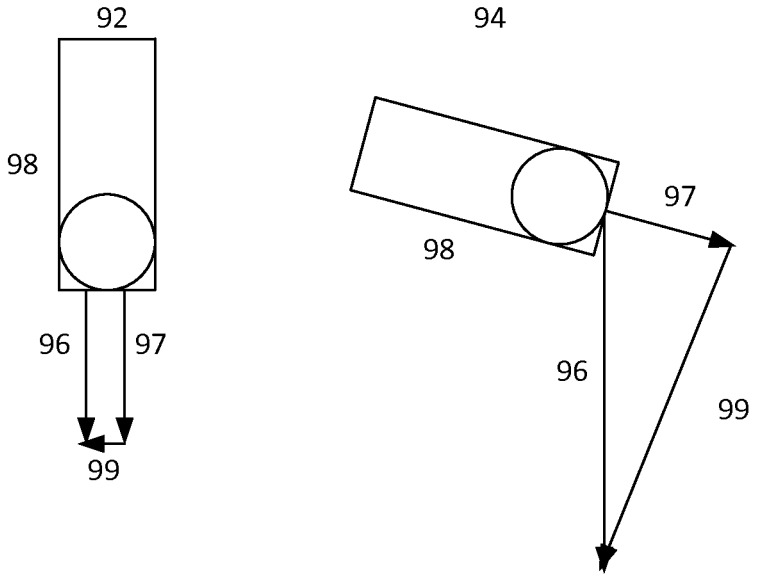

FIG. 2B shows a compass 98 in two different positions, 92, 94, from FIG. 2A. In the first position 92, the compass detects a first direction 96. The compass's direction is indicated as 97 and it may be a known distance from a particular location. For example, when affixed to a door, the compass may automatically determine the distance from the door jamb or a user may input a distance from the door jamb. The distance representing how far away from the door jamb the door is 99 may be computed by a variety of trigonometric formulas. In the first position 92, the door is indicated as not being separate from the door jamb (i.e., closed) 99. Although features 96 and 97 are shown as distinct in FIG. 2B, they may overlap entirely. In the second position 94, the distance between the door jamb and the door 99 may indicate that the door has been opened wide enough that a person may enter. Thus, the sensors may be integrated into a home security system, mesh network, or work in combination with other sensors positioned in and/or around an environment.

In some configurations, an accelerometer may be employed to indicate how quickly the door is moving. For example, the door may be lightly moving due to a breeze. This may be contrasted with a rapid movement due to a person swinging the door open. The data generated by the compass, accelerometer, and/or magnetometer may be analyzed and/or provided to a central system such as a controller 73 and/or remote system 74 as previously described. The data may be analyzed to learn a user behavior, an environment state, and/or as a component of a home security or home automation system. While the above example is described in the context of a door, a person having ordinary skill in the art will appreciate the applicability of the disclosed subject matter to other implementations such as a window, garage door, fireplace doors, vehicle windows/doors, faucet positions (e.g., an outdoor spigot), a gate, seating position, etc.

Sensors as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

FIGS. 3A-3B show examples of a security system as disclosed herein, which may be implemented over any suitable wired and/or wireless communication networks. One or more sensors 71, 72 may communicate via a local network 70, such as a Wi-Fi or other suitable network, with each other and/or with a controller 73.

FIGS. 3A-3B show examples of a security system and/or smart-home environment as disclosed herein, which may be implemented over any suitable wired and/or wireless communication networks. One or more sensors 71, 72 may communicate via a local network 70, such as a Wi-Fi or other suitable network, with each other and/or with a controller 73. The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The controller 73 shown in FIGS. 3A-3B that is communicatively coupled to the network 70 may be and/or include a processor. Alternatively, or in addition, the controller 73 may be a general- or special-purpose computer. The controller 73 may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors 71, 72 may communicate directly with a remote system 74. The remote system 74 may, for example, aggregate data from multiple locations, provide instruction, software updates, and/or aggregated data to a controller 73 and/or sensors 71, 72.

The sensor network shown in FIGS. 3A-3B may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIGS. 3A-3B may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIGS. 3A-3B.

For example, a smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIGS. 3A-3B, and the controller 73 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIGS. 3A-3B and the controller 73 may control an alarm system to provide a visual and/or audible alarm to the user of the smart-home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIGS. 3A-3B may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIGS. 3A-3B. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 72, 72 may detect the power and/or speed of a fan, and the controller 73 may adjusting the power and/or speed of the fan, accordingly. Smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, a smart-home environment may include one or more intelligent, multi-sensing, network-connected entry detectors (e.g., "smart entry detectors"). Such detectors may be or include one or more of the sensors 71, 72 shown in FIGS. 3A-3B.

The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. According to the operating mode of the security system, the system may output an alarm and/or a notification message (e.g., to a user device, such as a smartphone, wearable computing device, personal computer, audible message via a speaker, or the like).

The smart-home environment of the sensor network shown in FIGS. 3A-3B can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIGS. 3A-3B can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, smart watch, wearable computing device, a tablet, radio frequency identification (RFID) tags, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

In some embodiments, the security system may change the mode of operation according to the location of the device (e.g., a smartphone, wearable computing device, or the like) of the registered user. For example, the system may determine, using GPS data from the user device, that the device is outside of a predetermined range from the home or building, and the system may correspondingly switch the operation mode to an away mode or vacation mode if no other occupants are in the home or building. In some embodiments, the system may transmit a message to the user's registered device (e.g., smartphone, wearable computing device, or the like) to notify the user of the change in operation mode. Alternatively, or in addition, the system may transmit a request to the user's device, so that the user may confirm or deny the request to change the operating mode of the security system.

Alternatively, or in addition to registering electronic devices, the smart-home environment may make inferences about which individuals live in the home and are therefore users and which electronic devices are associated with those individuals. As such, the smart-home environment may "learn" who is a user (e.g., an authorized user) and permit the electronic devices associated with those individuals to control the network-connected smart devices of the smart-home environment (e.g., devices communicatively coupled to the network 70), in some embodiments including sensors used by or within the smart-home environment. Various types of notices and other information may be provided to users via messages sent to one or more user electronic devices (e.g., device 75). For example, the messages can be sent via email, short message service (SMS), multimedia messaging service (MMS), unstructured supplementary service data (USSD), as well as any other type of messaging services and/or communication protocols.

In some embodiments, the security system and/or the smart-home environment may learn (e.g., by aggregating data detected by the sensors over a period of time) the amount of exit time and/or exit patterns of a user. For example, the system may learn which doors of the home a user frequently exits from, what times the doors are used for exit, the patterns of movement in the house by the user prior to exit (e.g., so that the system may change the operating mode to a transition mode, before changing to an away mode when the user has left), the amount of time the user takes to exit the home, or the like. The system may learn to provide the user more time to exit the home if needed, so that an unwanted alarm is not output.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

The one or more sensors 71, 72 may be magnetic field sensors that detect a security event when a door and/or window of a building having the security system disclosed herein has been opened and/or compromised. In yet another example, the one or more sensors 71, 72 may be a smoke sensor and/or a carbon monoxide sensor that detect an environmental event when smoke is sensed and/or carbon monoxide is sensed.

More generally, the sensor 71, 72 may be any sensor capable of obtaining identifying information about a user, which can be used to determine whether the user is an authorized user by comparison to known information about the user.

In embodiments of the disclosed subject matter shown in FIGS. 3A-3B, the remote system 74 may be a law enforcement provider system, a home security provider system, a medical provider system, and/or a fire department provider system. When a security event and/or environmental event is detected by at least one of one sensors 71, 72, a message may be transmitted to the remote system 74. The content of the message may be according to the type of security event and/or environmental event detected by the sensors 71, 72. For example, if smoke is detected by one of the sensors 71, 72, the controller 73 may transmit a message to the remote system 74 associated with a fire department to provide assistance with a smoke and/or fire event (e.g., request fire department response to the smoke and/or fire event). Alternatively, the sensors 71, 72 may generate and transmit the message to the remote system 74. In another example, when one of the sensors 71, 72 detects a security event, such a window or door of a building being compromised, a message may be transmitted to the remote system 74 associated with local law enforcement to provide assistance with the security event (e.g., request a police department response to the security event).

The controller 73 and/or the remote system 74 may include a display to present an operational status message (e.g., a security event, an environmental event, an operational condition, or the like), according to information received from at least one or the sensors 71, 72. For example, the display of the controller 73 and/or remote system 74 may display the operational status message to a user while the user is away from the building having the security system disclosed herein. Alternatively, or in addition, the controller 73 may display the operational status message to a user when the user arrives at and/or departs (i.e., exits) from the building. For example, one or more sensors may identify and authenticate the user, and the security system may display the operational status message.

FIG. 3B shows a security system as disclosed herein that includes an alarm device 76, which may include a light and an audio output device. The alarm device 76 may be controlled, for example, by controller 73. The light of the alarm device 76 may be activated so as to be turned on when one or more sensors 71, 72 detect a security event and/or an environmental event. Alternatively, or in addition, the light may be turned on and off in a pattern (e.g., where the light is turned on for one second, and off for one second; where the light is turned on for two seconds, and off for one second, and the like) when one or more sensors 71, 72 detect a security event and/or an environmental event. Alternatively, or in addition, an audio output device of the alarm device 76 may include at least a speaker to output an audible alarm when a security event and/or an environmental event is detected by the one or more sensors 71, 72. For example, a security event may be when one or more sensors 71, 72 are motion sensors that detect motion either inside a building having the security system disclosed herein, or within a predetermined proximity to the building. The speaker of the alarm device 76 may, for example, output a message when the user arrives at the building or departs from the building according to the operational status of the security system (e.g., a security and/or environmental event has been detected, an operational issue with the security system has been detected, the security system has been armed and/or disarmed, or the like).

Figure 5:
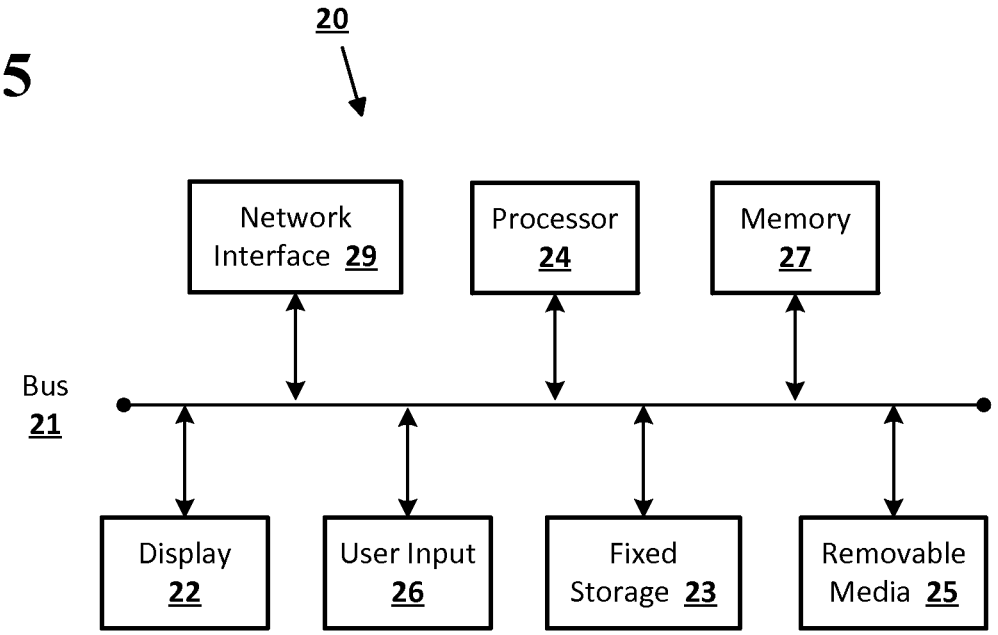
FIG. 5 shows an electronic device according to embodiments of the disclosed subject matter.

FIG. 3B shows a device 75 that may be communicatively coupled to a sensor. Although FIG. 3B illustrates that device 75 is coupled to sensor 72, the device 75 may be communicatively coupled to sensor 71 and/or sensor 72. The device 75 may be a computing device as shown in FIG. 5 and described below, and/or a key FOB. A user of the security system disclosed herein may control the device 75. When the device 75 is within a predetermined distance (e.g., one foot, five feet, 10 feet, 20 feet, 100 feet, or the like) from the sensor 72, the device 75 and the sensor 72 may communicate with one another via Bluetooth signals, Bluetooth Low Energy (BTLE) signals, Wi-Fi pairing signals, near field communication (NFC) signals, radio frequency (RF) signals, infra-red signals, and/or short-range communication protocol signals. The device 75 may provide identifying information to the sensor 72, which may be provided to the controller 73 to determine whether the device 75 belongs to an authorized user of the security system disclosed herein.

The controller 73 may monitor the location of the device 75 in order to determine whether to change the operation mode of the security system (e.g., from a home mode to an away mode). The controller 73 may change the mode of the security system according to, for example, whether the device 75 is within a predetermined area, a home, and/or a building. For example, when the registered electronic device is determined by the controller 73 to be within the home or building, and/or within a predetermined area adjacent to the building (e.g., the front or back yard of a home, or the like), the security system may change the operation mode to a home mode. When the controller 73 determines that the device 75 is outside of the home or building, and/or outside of the predetermined area adjacent to the home or building, the security system may change the mode from a home mode to an away mode (e.g., if there are no other occupants in the home or building). In some embodiments, the security system may transmit a notification to the device 75 to inform the user of the change in the operation mode, and/or to request confirmation of the change in the mode.

The security system may determine that the user is exiting the home or building according to the position of the user device and/or determination of the user location as detected by sensors 71, 72. The security system may, for example, change from the home mode to a transition mode as the user is attempting to exit. The system may transmit a message to the device 75 to request if the user needs more time to exit before the system changes from the transition mode to, for example, an away mode. With the device, or with a voice command that is detected by the sensors 71, 72, the system may provide extra time for the user to exit the home or building. Alternatively, the system may determine that the user has exited using data form the sensors 71, 72, and may change the mode from the transition mode to, for example, an away mode. The security system may request that the user acknowledge the change in mode of the security system via, for example, the device 75.

In some embodiments, the security system may provide audio (e.g., via s speaker) and/or visual indicators (e.g., via a display that may be included in and/or coupled to the controller 73, the device 75, or the like) to inform the user as to the mode that the security system is operating in (e.g., home, away, stay, transition, or the like). In particular, the system may indicate that it is in a transition mode so as to allow a user to exit the building or home. The visual indicator may include a particular color (e.g., yellow or the like) so that the user may easily know that the system is in a transition mode. In another example, the when a color is used to indicate the operating mode of the security system, color may be flashed and/or blinked so as to indicate a transition to another operation mode.

In example embodiments of the disclosed subject matter, the device 75 may be associated with an authorized user. The predetermined area may be defined, for example, according to, for example, geo-fencing data, placement and/or range of sensors 71, 72, a defined distance from the home or building having the security system disclosed herein, and the like. The controller 73 may change the operating mode of the security system (e.g., from home to away, or away to home, or the like) according to whether the device 75 is occupying the home or building.

For example, when the authorized user and the device 75 are outside of the predetermined area (e.g., the user is outside of the home or building), the controller 73 may controller 73 may change the operating mode of the security system (e.g., from home mode to away mode). In determining whether to change the operating mode of the security system, the controller may gather data from the sensors 71, 72, to determine whether any other person is in the building. When the security system is in an away mode, and the user and the device 75 return to the predetermined area of the security system (e.g., the user occupies the home or building), the controller may change the mode, for example, from an away mode to a home mode according to the signals received by the sensors 71, 72 from the device 75.

In FIGS. 3A-3B, the sensor 71, 72 may be a camera to capture an image of a face of a person to be transmitted to the controller 73, where the controller 73 compares the captured facial image with a pre-stored image. When it is determined by the controller 73 that at least a portion of the captured facial image matches the pre-stored image, the controller 73 determines that the person is an authorized user of the security system disclosed herein. The controller 73 may change the mode of the security system according to the determination of whether the person is an authorized user.

The sensor 71, 72 may be a camera to capture a retinal image from a person to be transmitted to the controller 73, where the controller 73 compares the captured retinal image with a pre-stored image. When it is determined by the controller 73 that at least a portion of the captured retinal image matches the pre-stored image, the controller 73 determines that the person is an authorized user of the security system disclosed herein. The controller 73 may change the mode of the security system according to the determination of whether the person is an authorized user.

The sensor 71, 72 may be a microphone to capture a voice of a person to be transmitted to the controller 73, where the controller 73 compares the captured voice with a pre-stored voice. When it is determined by the controller 73 that at least a portion of the captured voice matches the pre-stored voice, the controller 73 determines that the person is an authorized user of the security system disclosed herein.

When the sensor 72 and/or the controller 73 determine that the device 75 is associated with an authorized user according to the transmitted identification information, the sensor 72 and/or the controller 73 provide an operational status message to the user via a speaker (i.e., audio output 77), a display (e.g., where the display is coupled to the controller 73 and/or remote system 74), and/or the device 75. The operational status message displayed can include, for example, a message that a security event and/or environmental event has occurred. When the sensors 71, 72 have not detected a security and/or environmental event, a message may be displayed that no security and/or environmental event has occurred. In embodiments of the subject matter disclosed herein, the device 75 may display a source of the security event and/or environmental event, a type of the security event and/or environmental event, a time of the security event and/or environmental event, and a location of the security event and/or environmental event.

In embodiments of the disclosed subject matter, the device 75 may be communicatively coupled to the network 70 so as to exchange data, information, and/or messages with the sensors 71, 72, the controller 73, and the remote system 74.

In embodiments of the disclosed subject matter, the controller 73 can request entry of an access code from the device 75 and/or a keypad communicatively coupled to the controller 73. Upon receipt of the access code, the security system disclosed herein may be disarmed and/or may change operating modes (e.g., from an away mode to a home mode, or the like), and/or may provide an operational status message to the user via a display coupled to the controller 73 and/or the device 75. Alternatively, or in addition, an operational status message may be output via a speaker of the alarm device 76.

For example, a preset time (e.g., a preset timer of 15 seconds, 30 seconds, 1 minute, 5 minutes, or the like) may be set for the security system to allow for a user to exit the home, building, or a predetermined area before the system changes the operating mode (e.g., from a transition mode to an away mode, or the like). That is, the security system may have a timer that counts down from a preset time before changing the operating mode. In some embodiments, the system may operate in a transition mode during the count down, and then may change to a different operating mode when the countdown in complete (e.g., to an away mode or the like). The predetermined area may be a designated perimeter surrounding a home or building, or any other suitable area. An active count down timer may be displayed on a display that is coupled to the controller 73 and/or the alarm device 76. Alternatively, or in addition, the active count down timer may be displayed on a user's electronic device (e.g., device 75) that may be registered with the controller 73 and/or alarm system 76. A preset time may be set for the security system to allow for a user to enter the home, business, and/or predetermined area and change the operating mode (e.g., from an away mode to a home mode). The preset time for entry and the preset time to exit may be the same amount of time, or can be set to provide different amounts of time.

If a user needs more time to enter or exit the home, building, and/or predetermined area with the security system, an electronic device of the user (e.g., a smartphone, smart watch, wearable computing device, a key FOB, RFID tag, or the like, such as device 75) can request, upon receiving input from the user, that the controller 73 provide additional time beyond the preset time to allow for the user to enter or exit the home. Alternatively, or in addition, the security system disclosed herein may extend the preset time to enter or exit. For example, the time may be extended for exiting the home while the user and/or the user's electronic device are in the home. Alternatively, or in addition, the device 75 may transmit a command (e.g., when input is received from the user) to the controller 73 to disengage the exit process (e.g., the controller 73 and/or the alarm device 76 are disengaged from counting down the preset time before changing the operating mode of the system). In some embodiments, the security system may query the user whether the user needs more time to exit, by outputting an audible message (e.g., via a speaker) and/or a visual message (e.g., via a display device that is part of a controller or a user device). The user may respond to the system query via a voice command (e.g., that is received by a sensor, such as sensors 71, 72, that may include a microphone) and/or via a user input (e.g., received via the device 75 and/or the controller 73).

In another example, when the user returns to the home, building, or the predetermined area, a preset time for entry to disarm the alarm device 76 and/or change the operating mode of the security system may be extended according to whether the user has an electronic device (e.g., device 75, which may be a smartphone, smart watch, wearable computing device, key FOB, RFID tag, fitness band or sensor, or the like) that is registered with the controller 73. That is, the sensors, 71, 72 may detect the presence of the device 75 with the user, and may change the operating mode of the security system (e.g., from an away mode to a home mode, or the like). When the sensors 71, 72 determine that the user does not have the device 75, the controller 73 may extend the preset time so that a user may be given additional time to enter a code on, for example, a keypad communicatively coupled to the controller 73, to disarm the alarm device 76 and/or change the mode of the security system (e.g., from an away mode to a home mode, or the like).

In embodiments of the disclosed subject matter, when the user returns to the home, building, predetermined area, and is identified by the sensors 71, 72 and/or controller 73 as being an authorized user, the mode of the security system may be changed (e.g., from an away mode to a home mode), and one or more of the sensors 71, 72 may be disabled. For example, one or more of the sensors 71, 72 may be motion sensors, and may be disabled by the controller 73 when the person detected by the sensors 72, 72 is the authorized user.

As illustrated in FIGS. 3A-3B, a security system can include sensors (e.g., sensors 71, 72) to detect a location of at least one user, and generate detection data according to the detected location of at least one user of the security system. The detection data may be generated by the sensors 71, 72. For example, the at least one user may be one or more members of a household, and the security system may monitor their location using the sensors 71, 72 to determine whether to arm or disarm the alarm device 76. A processor, such as the controller 73 illustrated in FIGS. 3A-3B and described above, may be communicatively coupled to the sensors 71, 72, and can receive the detection data. The controller 73 can determine whether the at least one user is occupying the home or building, or is within a predetermined area, according to the detection data. The predetermined area may be set according to the boundaries of a home or building, geofencing data, motion data, a door positon event, a distance from one or more sensors, and the like.

In some embodiments, the sensors 71, 72 can detect that a location of the user is outside of the home, building, and/or predetermined area, and that a user's first electronic device (e.g., a smartphone, smart watch, wearable computing device, or the like) is within the home, building, and/or predetermined area. The controller 73 can determine whether to change the operating mode of the security system according one a location of a user's second electronic device (e.g., a key FOB, radio frequency identification (RFID) tag, fitness band or sensor, or the like), geofencing data, and the detection data from the sensors 71, 72.

The security system disclosed herein includes an alarm device, such as the alarm device 76 illustrated in FIG. 3B and discussed above, which can be armed or disarmed by the controller 73 according to the determination as to whether the at least one user is within the home, building, and/or predetermined area.

For example, if the controller 73 determines that the members of a household (e.g., the users of the home security system) have exited the home or building, and/or are outside of the predetermined area, the controller 73 may change the operating mode of the security system (e.g., from a home mode to an away mode). The sensors 71, 72 may determine the location of the members of the household according to their respective electronic devices (e.g., smartphones, smart watches, wearable computing devices, radio frequency identification (RFID) tags, fitness bands or sensors, tablet computers, key FOBs, and the like), according images captured by the sensors, according to the sensors detecting one or more doors opening and closing, and the like. The controller 73 may aggregate detection data from the sensors 71, 72 and store it in a storage device coupled to the controller 73 or the network 70. The data aggregated by the controller 73 may be used to determine entrance and exit patterns (e.g., what days and times users enter and exit from the house, what doors are used, and the like) of the members of the household, and the controller 73 may change the security mode according to the determined patterns.

In some embodiments, the security system may "learn" the exit patterns of the users, and may take action when the user action is different from the learned patterns. For example, when the system determines that the user is exiting the home, but the user is taking a longer amount of time that usual, the system may notify the user (e.g., via an audio and/or visual message) that the transition mode may be extended so as to allow the user additional time to exit, before the system changes to, for example, an away mode. If the system determines that the exit pattern of the user is different than a learned exit pattern, the system may adjust the amount of time that the system operates in the transition mode before changing to a different mode (e.g., when the system determines that the user exits, or determines that the user that the user is not leaving the home due to an event, such as a telephone call, another person arriving at the home, or the like).

In embodiments of the disclosed subject matter, one or more user electronic devices (e.g., device 75) can be registered with the processor, and the at least one of the sensors 71, 72 transmits a location request signal to the device 75. In response to the location request signal, the device 75 can transmits a location signal, and the controller 73 can determine the location of the device 75 according to the received location signal. The location request signal and the location signal can be Bluetooth signals, Bluetooth Low Energy (BTLE) signals, radio frequency (RF) signals, near field communications (NFC) signals, and the like.

The controller 73 can transmit a request message to be displayed by the device 75. The message may be, for example, a reminder to change the operating mode of the security system. Upon displaying the message the electronic device receives input to change the operating mode of the security system according to the displayed request message, and transmits the received input to the controller 73 so as to control the security system. For example, the message may display a selectable button to change the operating mode of the alarm device 76. In another example, the controller can request a code from the user to change the operating mode of the alarm device 76. When the user provides the code to the device 75, which correspondingly transmits the entered code to the controller 73, the controller 73 may control the changing of the mode of the security system. Alternatively, or in addition, the controller 73 can control the alarm device 76 to be automatically change to an away mode when the user is outside of the home, building, and/or predetermined area. Alternatively, or in addition, the controller may control the changing of the operating mode of the alarm device 76 according to a code that entered in a keypad that is communicatively coupled to the controller 73 (e.g., from an away mode to a home mode). Alternatively, or in addition, the user may change the operating mode of the alarm device 76 by placing the device 75 (e.g., a registered smartphone, smart watch, key FOB, RFID tag, fitness band or sensor, wearable computing device, or the like) within a predetermined distance to the sensors 71, 72, where the sensors determine that the device 75 is a registered device, and the controller 73 controls the alarm device 76 to change the operating mode (e.g., change from an away mode to a home mode).

In embodiments of the disclosed subject matter, authentication requirements for changing the operating mode of the alarm device 76 may be reduced when a device 75 is used to change the operating mode, and the device 75 is a registered device. When a button on the registered device 75 or displayed by the device 75 is used to change the mode of the alarm device 76, the user may not have to enter a code, a shortened PIN code, a voice code, or the like.

When the sensors 71, 72 for an entry door to the home or building become disconnected from the network 70 and the controller 73, and the alarm device 76 is operating, for example, in an away mode, the user may still re-enter the home. The security system may learn which doors are used by the user to enter and/or exit a home. The sensors 71, 72 associated with the doors that are used to enter and/or exit the home may store identifying information, so that the user may present a device 75 to the sensors 71, 72 to exchange identifying information to allow the user to enter the door. Once the user enters, the user may manually change the mode of the alarm device 76 by entering a security code.

In the security system disclosed herein, sensors 71, 72 can detect a security event, such as a door event (e.g., where a door to a house is opened, closed, and/or compromised) or a window event (e.g., where a window of a house is opened, closed, and/or compromised). For example, the sensors 71, 72 may have an accelerometer that identifies the force on the door or window as a compromising event. In another example, the sensors 71, 72 may contain an accelerometer and/or compass, and the compromising event may dislodge the sensor from the door or window, and the motion of the sensor 71, 72 may identify the motion as a compromising event.

The sensors 71, 72 may be door and/or window sensors which may determine whether the door and/or window is opened from the inside or the outside (e.g., inside the house, building, and/or a predetermined area). Alternatively, or in addition, the controller 73 may determine, according to data received from the sensors 71, 72, whether a door and/or window are opened and/or closed from the inside or outside. For example, as discussed above, the sensors 71, 72 may include an accelerometer and/or compass, and thus the direction of a door opening may be determined. In some embodiments, the sensors 71, 72 may detect a person and/or user is within a distance from the door and/or window, where the person and/or user may be detected to be on the outside or the inside. The sensors 71, 72 may determine when the door and/or window is opened, and may correlate the detected user position (e.g., where the detected position is inside or outside) with the opening of the door and/or window. Alternatively, or in addition, when a door is opened, a smart doorknob may determine whether the door is opened from the inside or the outside.

In some embodiments of the disclosed subject matter, the controller 73 may control the alarm device 76 so as to refrain from activation (e.g., outputting an audio and/or visual alarm) when the controller determines that the door and/or window is opened from inside the home, building, and/or predetermined area.

In embodiments of the disclosed subject matter, the controller 73, remote system 74, and/or device 75 may set a failsafe period with the alarm device 76. That is, the failsafe period may be provided for users to exit the home, building, and/or predetermined area. After the expiration of the failsafe period, the alarm device 76 of the security system may be armed. In some embodiments, the controller 73 may reduce the failsafe period when the sensors 71, 72 detect that one or more users have exited the home, building, and/or predetermined area.

The controller 73 may control the output an alarm from the alarm device 76 according to whether the detected door event or window event is from an outside location (e.g., outside the house, building, or the like). That is, the controller 73 may control the alarm device 76 to output an audible alarm and/or message via a speaker when a door event or window event is detected by the sensors 71, 72. A light of the alarm device 76 may be activated so as to be turned on when one or more sensors 71, 72 detect a security event, such as a door or window event. Alternatively, or in addition, a light may be turned on and off in a pattern (e.g., where the light is turned on for one second, and off for one second; where the light is turned on for two seconds, and off for one second, and the like) when one or more sensors 71, 72 detect a security event such as the window and/or door event.

In embodiments of the disclosed subject matter, the controller 73 can set and/or designate one or more doors, windows, and/or entryways, and the like that may be opened and/or used for exit upon arming of the alarm device 76. Alternatively, or in addition, the device 75 may control the selection of the one or more doors, windows, and/or entryways to be designated for entry and/or exit. That is, the selected doors, windows, and/or entryways may be opened and/or used for exit when the security system is operating in, for example, the home mode. For example, a door can be selected for exit by the controller 73, so that a user may exit the house or building without the system outputting an alarm and/or notification message. The selected door may be a door that opens from inside the home, building or predetermined area to outside the home, building, or predetermined area. That is, the door may be an exterior door that leads from, for example, an interior space of a home or building, to an area outside of the home or building. After exit of the user, the controller 73 may de-select the door, such that further attempts to open and/or close the door will output an alarm from the alarm device 76 and/or output a notification message.

The controller 73 can control the setting of the operation mode of the security system according to a preset time period for a user to enter or exit a home, building, and/or predetermined area associated with the security system. The preset time can be adjusted by the controller 73 according to the user. For example, as discussed herein, the controller 73 can aggregate data from the sensors 71, 72 to determine when a user enters and exits the home (e.g., the days and times for entry and exit, the doors associated with the entry and exit, and the like). For example, the controller 73 can adjust the amount of time for the security system to be in the transition mode to be longer or shorter (e.g., before changing to the away mode), according to the amount of time the user takes to exit the house according to the aggregated data.

In the security system disclosed herein the at least one sensor determines that the user is outside of the home, building, and/or predetermined area for a time greater than a preset time, the controller 73 can control the security system to transition from a first security mode to a second security mode. The second security mode may provide a higher level of security than the first security mode. For example, the system may transition from a first mode, such as a home mode, to a second mode, which may be a vacation mode, where the user of the security system disclosed herein (e.g., the members of a household) are away from the house for a period of time (e.g., 1 day, 3 days, 5 days, 1 week, 2 weeks, 1 month, or the like). As discussed herein, the controller 73 may aggregate the detection data received from the sensors 71, 72 over a preset time (e.g., 1 week, 1 month, 6 months, 1 year, or the like) to determine a pattern for when the user is within the predetermined location or not.

That is, in embodiments of the disclosed subject matter, the controller 73 may configure, set, and/or store allowance data which may determine which entryways may be used for entry and exit to a home, building, and/or predetermined area. The device 75 may control the controller 73 so as to configure, set, and/or store the allowance data. In an example, the controller 73 may configure the allowance data to allow a user to exit though one or more preset doors without activating the alarm device 76. In another example, the controller 73 may configure the allowance data to allow motion within the home, building, and/or predetermined area without activating the alarm device. That is, the sensors 71, 72 may detect motion and/or a user, and, according to the allowance data, and the controller 73 may control the alarm device 76 to refrain from activating an audio and/or visual alarm, and/or from transmitting a notification message. In some embodiments, the allowance data may be used in conjunction with user identification data (e.g., information from the sensor 71, 72 which identify the user as an authorized user) by the controller 73 to control the alarm device 76 to refrain from activating an audio and/or visual alarm, and/or from transmitting a notification message.

The allowance data may include, for example, selection of one or more doors, windows, entryways, predetermined areas (e.g., rooms, outdoor areas, predefined areas, and the like), users, times (e.g., times allotted to exit before arming the alarm device 76, times of day to allow entry and/or exit, etc.), and the like to allow exit from the home, building, and/or predetermined area (e.g., without activation of the alarm device 76).

In an example, the allowance data may be configured by the controller 73 so that the sensors 71, 72 detect security events from a perimeter of a predetermined area (e.g., rather than in an interior of a home or building). In this example, the users may be in the home, as confirmed by the sensors 71, 72, and the allowance data may be configured so that the sensors 71, 72 disposed on a perimeter of a predefined area (e.g., around the perimeter of a property on which the home is) may be active.

In another example, the controller 73 may configure the allowance data so that when at least one user is within the home, building, and/or predetermined area, one or more other users are permitted to enter the home, building, and/or predetermined area or be within a preset distance of the predetermined area without activating the alarm device 76 so as to output an alarm and/or transmit a notification message. In this example, the sensors 71, 72 may identify the other users as users that are registered with the controller 73 and/or the remote system 74.

In another example, the controller 73 may configure the allowance data so as to allow a user (e.g., a user registered with the controller 73 and/or remote system 74) to exit the home, building, and/or predetermined area without activating the alarm device 76 so as to output an alarm and/or transmit a notification message.

In some embodiments, the security system may configure the allowance data so as to change the operating mode according to data detected by the sensors. For example, when the sensors detect that a user is leaving the home or building, the system may change from a home mode to a transition mode to allow for the user to exit. The allowance data may determine the length of time to allow the user to exit the home or building before changing to an away mode. The allowance data may also control the security system so that as long as the user is still in the house, but is attempting to leave, the system will remain in transition mode. In some embodiments, if the system is in a transition mode, but determines, according to the user activity, that the user is no longer leaving the home, the system may change the operating mode (e.g., to the mode that the system was in prior to the transition mode, such as the home mode or stay mode).

In embodiments of the disclosed subject matter, the allowance data may be configured so that the operating mode may change according to room in the home or building a user is determined to be in. For example, if the system determines from the sensor data that the user is in or has moved to a bedroom, the system may change an operating mode from a home mode to a stay mode. If the system determines, for example, that the user is in or has moved to the kitchen of the home, the system may change to a home mode. If the system determines that the user has moved to the garage and has opened the garage door, the system may change to a transition mode, as it is expect that the user will exit the garage (e.g., in a car). When the user leaves (e.g., as detected by the sensors), the system can change from the transition mode to an away mode. That is, when the user is determined to move to and/or be in particular rooms of a home that are designated by the allowance data, the system may change to a different operating mode.

Figure 4:
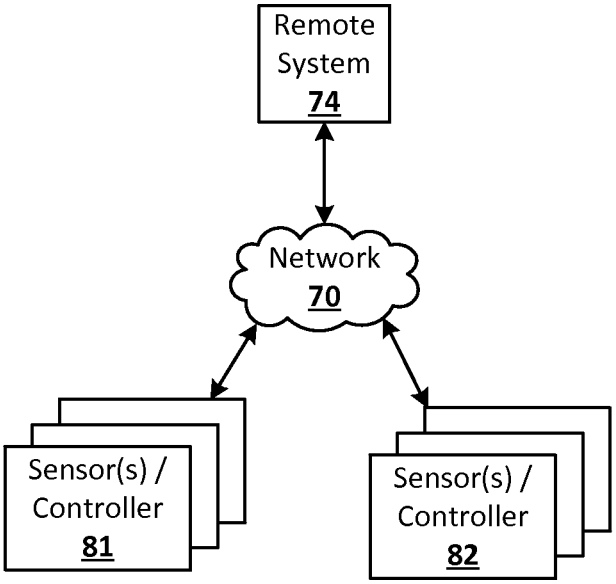
FIG. 4 shows a remote system to aggregate data from multiple locations having security systems according to an embodiment of the disclosed subject matter.

In some configurations, as illustrated in FIG. 4, a remote system 74 may aggregate data from multiple locations, such as multiple buildings, multi-resident buildings, and individual residences within a neighborhood, multiple neighborhoods, and the like. In general, multiple sensor/controller systems 81, 82 as previously described with respect to FIGS. 3A-3B may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., a user's current location, a location of the user's house or business, or the like), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Embodiments of the presently disclosed subject matter may be implemented in and used with a variety of computing devices. FIG. 5 is an example computing device 20 suitable for implementing embodiments of the presently disclosed subject matter. The computing device may be the device 75 illustrated in FIG. 3B and discussed above. The device 20 may be used to implement a controller, a device including sensors as disclosed herein, or the like. Alternatively or in addition, the device 20 may be, for example, a desktop or laptop computer, or a mobile computing device such as a smart phone, tablet, key FOB, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen and/or lights (e.g., green, yellow, and red lights, such as light emitting diodes (LEDs) to provide the operational status of the security system to the user, as discussed above), a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide a communications link with the network 70, sensors 71, 72, controller 73, and/or the remote system 74 as illustrated in FIGS. 3A-3B. The network interface 29 may provide such connection using any suitable technique and protocol as will be readily understood by one of skill in the art, including digital cellular telephone, radio frequency (RF), Wi-Fi, Bluetooth®, Bluetooth Low Energy (BTLE), near-field communications (NFC), and the like. For example, the network interface 29 may allow the device to communicate with other computers via one or more local, wide-area, or other communication networks, as described in further detail herein.

Figure 6:
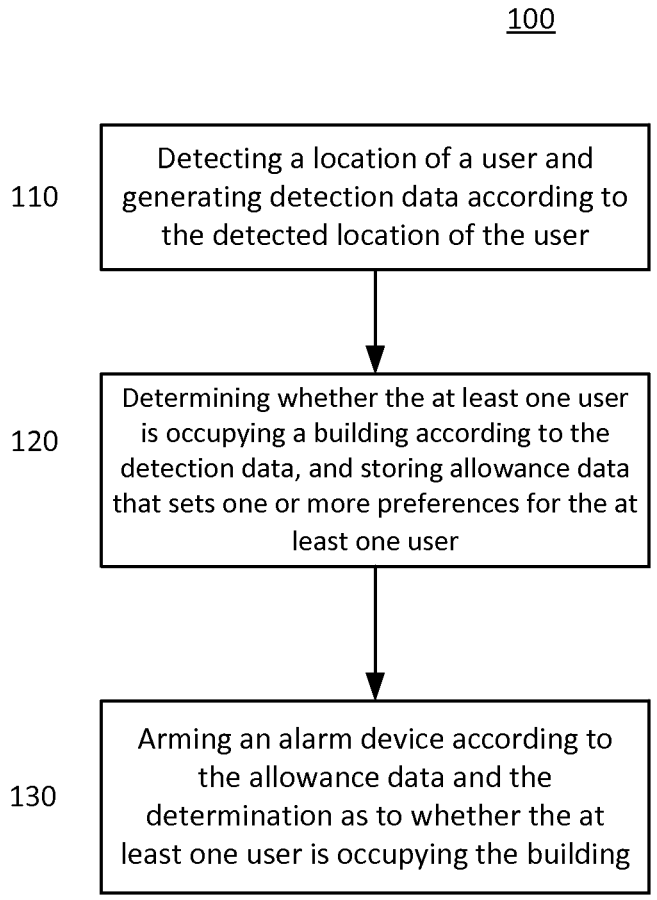
FIG. 6 shows example operations of a method of providing exit allowances for a security system according to an embodiment of the disclosed subject matter.

FIG. 6 shows example operations of a method 100 of providing exit allowances for a security system according to an embodiment of the disclosed subject matter. At least one of a plurality of sensors (e.g., sensors 71, 72 shown in FIGS. 3A-3B and described above) may determine a location of at least one user at operation 110. The sensors 71, 72 may generating detection data according to the detected location of the user at operation 110. A processor, such as controller 73 shown in FIGS. 3A-3B and described above, which is communicatively coupled to the sensors 71, 72, can receive the detection data, and determine whether the user is occupying a building according to the detection data at operation 120. That is, it may be determined whether the user has exited the building. The controller 73 may store allowance data that sets one or more preferences for the user at operation 120. The controller 73 may arm an alarm device, such as alarm device 76 that is communicatively coupled to the controller 73, according to the allowance data and the determination as to whether the at least one user is occupying the building at operation 130. That is, it may be determined whether the user has exited the building, and arm the alarm device accordingly.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A security system comprising:

a sensor to detect a location of at least one user, and generate detection data according to the detected location of the at least one user, wherein the sensor is one from the group consisting of: a door sensor and a window sensor;

a processor communicatively coupled to the sensor to receive the detection data, to determine whether a respective door or window is opened from inside the building based on the detection data, to determine whether the at least one user is occupying a building according to the detection data, to store allowance data that sets one or more preferences for the at least one user, to determine whether the user is entering or exiting the building as expected based on user history data, the allowance data, and the detection data, and to adjust a time period included in the allowance data so as to provide additional time for the at least one user to enter or exit the building based on the determination of whether the user is entering or exiting the building as expected and based on the detection data from the sensor; and an alarm device, communicatively coupled to at least the processor, that is armed or disarmed by the processor according to the allowance data and the determination as to whether the at least one user is occupying the building.

2. The system of claim 1, wherein the processor has a preset timer that is activated to count down when the at least one user has exited the building.

3. The system of claim 2, further comprising:

a display that is coupled to at least one of the group consisting of the processor and the alarm device to display the countdown of the timer.

4. The system of claim 1, wherein the sensor is a motion sensor that is disabled by the processor when the at least one user is occupying the building.

5. The system of claim 1, wherein the processor controls the alarm device to refrain from activation when the door or window is opened from inside the building.

6. The system of claim 1, wherein the processor sets one or more items selected from a group consisting of: doors and windows for entry or exit after arming of the alarm device.

7. The system of claim 6, wherein the one or more doors are those that open from inside the building to outside the building.

8. The system of claim 1, wherein a failsafe period is set by the processor to arm the alarm device when the failsafe period is expired.

9. The system of claim 8, wherein the processor reduces the failsafe period when at least one of the sensor and the processor determines that the at least one user is outside the building.

10. The system of claim 1, wherein the processor configures the allowance data to allow the at least one user to exit though one or more preset doors without activating the alarm device.

11. The system of claim 1, wherein the processor configures the allowance data to allow motion within the building without activating the alarm device.

12. The system of claim 1, wherein the processor configures the allowance data so as to allow window opening without activating the alarm device and to provide a notification to the user.

13. The system of claim 1, wherein the processor configures the allowance data so that the sensor detects security events from a perimeter of the building.

14. The system of claim 1, wherein the processor configures the allowance data so that when the at least one user is occupying the building, one or more other users are permitted to enter the building or be within a preset distance of the building without activating the alarm device.

15. The system of claim 14, wherein the one or more other users are users that are registered with the processor.

16. The system of claim 1, wherein the processor configures the allowance data so as to allow the at least one user to exit the building without activating the alarm device.

17. A method comprising: detecting, by a sensor, a location of at least one user, and generating detection data according to the detected location of the at least one user;

receiving, by a processor communicatively coupled to the sensor, the detection data, determining whether a respective door or window is opened from inside the building according to the detection data received from the sensor, determining whether the at least one user is occupying a building according to the detection data, and storing allowance data that sets one or more preferences for the at least one user; determining, by the processor, whether the user is entering or exiting the building as expected based on user history data, the allowance data, and the detection data; adjusting, by the processor, a time period included in the allowance data so as to provide additional time for the at least one user to enter or exit the building based on the determination of whether the user is entering or exiting the building as expected and based on the detection data from the sensor; and arming an alarm device that is communicatively coupled to the processor according to the allowance data and the determination as to whether the at least one user occupying the building.

18. The method of claim 17, further comprising:

activating a preset timer to count down when the at least one user has exited the building.

19. The method of claim 18, further comprising:

displaying, on a display coupled to the alarm device, the countdown of the timer.

20. The method of claim 17, further comprising:

determining, with the processor, whether a respective door or window is opened from inside the building according to motion data received from the sensor.

21. The method of claim 20, further comprising:

controlling, by the processor, the alarm device to refrain from activation when the door or window is opened from inside the building.

22. The method of claim 17, further comprising:

configuring the allowance data, by the processor, so as to allow the at least one user to exit the building without activating the alarm device.

23. The method of claim 17, further comprising:

setting, by the processor, a failsafe period to arm the alarm device when the failsafe period is expired.

24. The method of claim 23, further comprising:

reducing, by the processor, the failsafe period when the sensor or the processor determines that the at least one user is outside the building.

25. The method of claim 17, further comprising:

configuring, by the processor, the allowance data to allow the at least one user to exit though one or more preset doors without activating the alarm device.

26. The method of claim 17, further comprising:

configuring, by the processor, the allowance data to allow motion within the building without activating the alarm device.

27. The method of claim 17, further comprising:

configuring, by the processor, the allowance data so as to allow window opening without activating the alarm device and providing a notification to the user.

28. The method of claim 17, further comprising:

configuring, with the processor, the allowance data so that the sensor detects security events from a perimeter of the building.

29. The method of claim 17, further comprising:

configuring, with the processor, the allowance data so that when the at least one user is occupying the building, permitting one or more other users to enter the building or be within a preset distance of the building without activating the alarm device.

30. The method of claim 29, wherein the one or more other users are users that are registered with the processor.

* * * * *